US005137663A

United States Patent [19]

Conaway

[11] Patent Number: 5,137,663

[45] Date of Patent: Aug. 11, 1992

[54] PROCESS AND CONTAINER FOR ENCAPSULATION OF WORKPIECES FOR HIGH PRESSURE PROCESSING

[75] Inventor: Robert M. Conaway, Columbus, Ohio

[73] Assignee: Vital Force, Inc., Columbus, Ohio

[21] Appl. No.: 567,116

[22] Filed: Aug. 13, 1990

[51] Int. Cl.[5] ..... B29C 43/02

[52] U.S. Cl. ..... 264/36; 264/40.4; 264/63; 264/82; 264/102; 264/109; 264/320; 425/78; 425/405.2; 425/405.1

[58] Field of Search ..... 264/40.1, 40.4, 56, 264/63, 65, 102, 109, 39, 82, 36, 320; 425/405.2, 78, 405.1

[56] References Cited

U.S. PATENT DOCUMENTS

| | | | |
|---|---|---|---|
| 3,317,641 | 5/1967 | Heier | 264/102 |
| 3,413,392 | 11/1968 | Meadows | 264/102 |
| 4,155,476 | 5/1979 | Lipiec et al. | 425/405.2 |
| 4,217,087 | 8/1980 | Bowles | 425/78 |
| 4,471,949 | 9/1984 | Ishii | 425/405.2 |
| 4,582,681 | 4/1986 | Asari et al. | 419/49 |
| 4,661,315 | 4/1987 | Wiech, Jr. | 419/10 |
| 4,732,556 | 3/1988 | Chiang et al. | 425/405.2 |
| 4,756,680 | 7/1988 | Ishii | 425/78 |

*Primary Examiner*—Mary Lynn Theisen
*Attorney, Agent, or Firm*—George Wolken, Jr.

[57] ABSTRACT

A container for the high temperature, high pressure processing of workpieces is disclosed. Such container has a removable plug with a deformable seal permitting rapid access to the interior of the container following processing. The removable plug contains various access ports allowing continuous monitoring of the interior of the container, continuous evacuation of gases, and introduction of controlled processing gases as may be required for various workpieces.

25 Claims, 4 Drawing Sheets

PROCESS AND CONTAINER FOR ENCAPSULATION OF WORKPIECES FOR HIGH PRESSURE PROCESSING

BACKGROUND OF INVENTION

This invention relates generally to the field of high pressure processing of materials, and more particularly to apparatus and methods for the encapsulation of workpieces requiring high pressure processing, and methods for performing such processing.

There is a continuing need in the modern economy for improved materials, produced more efficiently and at lower cost. One common procedure is the application of heat and pressure to a workpiece in the process known as "hot isostatic pressing" or "HIP".

HIP is a very versatile tool for the production or improvement of materials in a variety of ways. HIP is frequently used to eliminate porosity from a material, thereby producing a fully dense material with improved properties. HIP is also used to bond together dissimilar materials which are not conveniently otherwise joined into a single, integrated workpiece. Also, HIP is commonly used to compress powders into a fully dense, solid part.

We will use the term "workpiece" to denote any material, or combination of materials, to be HIP processed. As noted above, such workpieces could be a single solid material requiring densification, dissimilar materials to be bonded together, or powders requiring compaction. In the case of powders, the powders may be held in the desired final shape by an appropriate mold, by mechanical pressing, by the use of binding agents, or by several other techniques and combinations of techniques well known in the field. For economy of language, "workpiece" as used herein will encompass any such starting material for HIP.

HIP requires pressure to be applied uniformly to all exposed surfaces of the workpiece. This is in contrast to forging or other methods of pressure processing in which pressure is applied typically to one portion of a workpiece. The workpiece is typically constrained in a holder, thereby generating nonuniform pressures along different directions of the workpieces.

In HIP, pressures are typically generated by immersing the workpiece in a fluid (including in this term commonly considered gases when maintained at lower pressure); or powders not themselves adversely affected by the pressures applied during HIP; or surrounding the workpiece with a solid or glass having a low yield point. The pressure on the fluid (or powder, or solid) is increased typically by mechanical or thermal means, until the desired pressure is applied to the workpiece for the desired length of time.

Many workpieces can be immersed directly in the HIP pressure-transmitting fluid or power without the need for encapsulation in a container. Such workpieces are said to lack "open porosity". That is, all voids, spaces or manifestations of porosity in the workpiece are completely surrounded by nonporous portions of the workpiece, denying the pressure-transmitting medium acess to the porous region. When such workpieces without open porosity are immersed in a pressure-transmitting medium, application of suitable heat and pressure will typically remove remaining porosity, which is the goal of the HIP process.

Other workpieces, however, possess open porosity. When HIP is carried out on such workpieces in the absence of encapsulation, pressure-transmitting medium typically penetrates inside such sites of open porosity. Thus, under elevated pressures, such open porosity is not removed as pressure is applied to the internal surface of the porous site, tending to keep it open, as well as externally on the outside of such site. Pressure is thus balanced and open porosity will remain following HIP processing. Many commonly fabricated workpieces have open porosity, requiring encapsulation in a pressure-tight container or "can" to be fully densified by HIP processing. Powders to be consolidated into a single, dense workpiece have such open porosity and, therefore, cannot be consolidated without encapsulation. Even fully dense workpieces require encapsulation if two or more such workpieces are to be bonded together into a single, integrated, fully dense workpiece. Thus, in the practical application of HIP, pressure-tight cans are frequently required. The effective use of cans for HIP processing is the subject of the present invention.

The present invention relates to a reusable can having special features as described below. The features of this can should not be confused with features commonly occurring in the pressure vessel itself in which HIP processing is performed. HIP processing requires high pressures to be uniformly applied to a workpiece. This pressure is typically applied by compressing a "fluid" (as defined above) having the workpiece immersed therein. Many workpieces cannot "go naked" into pressurizing fluid, but must be encapsulated in a can. The pressurizing fluid (and canned or uncanned workpiece immersed therein) must be confined in a pressure vessel strong enough to withstand the high pressures of HIP processing and not significantly deform or change shape. Such pressure vessels are in variably designed to be reusable and invariable designed to have access ports through which pressure and temperature can be monitored. However, since the pressure vessel is not deformed, its rigidity and reuse are easily accomplished, and well known in the prior art. However, the can (if any) encapsulating the workpiece must deform (compress) in order for the encapsulated workpiece to "feel" the high pressure on the outside of the can. Making such a can both deformable and reusable is the subject of the present invention.

Canning for HIP processing is conventionally carried out by one of two general procedures. In one procedure, a pressure-tight material (typically a metal) is fabricated snugly around the outside of the workpiece to be HIP processed. Such a "conformal can" is completely sealed around the workpiece, typically by welding. The workpiece and can are then processed by HIP. The can is removed from around the workpiece (typically be mechanical removal or dissolving with chemicals), and the HIP-processed workpiece is removed. Often, the internal surface of the conformal can is coated by a chemical release agent, chosen to facilitate the separation of can from workpiece. Nevertheless, conformal canning is a time-consuming process, and results in the destruction of the can.

The other conventional encapsulation process is "media canning". In this process, the workpiece to be HIP processed is surrounded by a material (typically a granular material such as a silica sand, graphite, etc.) having grain sizes too large to penetrate into the workpiece's open porosity. Very viscous liquids or glasses are also used for media HIP provided the viscosity of such substances is sufficiently great to avoid significant penetration of open porosity. The workpiece and canning medium are then encapsulated into a can (which may have any convenient shape, typically cylindrical). The sealed can containing workpiece and granular canning medium is HIP processed in a conventional manner. The can is removed as in conformal canning and the fully densified workpiece removed and separated from the canning medium.

For many workpieces, residual gases surrounding the canned workpiece (either conformally or media canned) may be incorporated into the workpiece during HIP processing, harming the properties of the resulting HIP-processed workpiece. For this reason, it is common during both media and conformal canning for a vacuum to be drawn on the inside of the can just prior to final welding and sealing. This removes substantially all the gas surrounding the workpiece in the can, but does not remove those gases generated from within the workpiece itself (or the canning medium, if present) during the heat and pressure of the HIP process.

These conventional canning procedures suffer from several drawbacks, the improvement of which is the subject of the present invention.

Conventional media or conformal canning is a slow process. The need to weld under vacuum and remove the can following HIP takes significant amounts of time and labor, increasing HIP processing costs and reducing throughput.

Conventional canning destroys the can. For large workpieces, or cans designed to hold numerous workpieces, a can could cost thousands of dollars. Conventional canning reduces this can to scrap.

Quality control is always a concern in HIP processing. An expensive and lengthy HIP processing run can be completely ruined (along with the workpieces and the can) if the can is not completely pressure-tight during the HIP run. Conventional canning technology does not permit continuous monitoring of conditions inside the can during HIP processing.

Many important workpieces are made by consolidation of powders with the aid of a binding agent. The resulting partially densified or "preformed" workpiece contains in corporated binding agent which must be removed. Typically, such "debinding" processes required careful heating to volatilize and driver off the binding agent without harming the properties of the material or changing the shape of the workpiece. It is not unusual for such careful heating and debinding to require many days to complete. The present invention indicates an alternative, much faster, approach to debinding.

SUMMARY AND OBJECTS OF THE INVENTION

The present invention relates to a container for encapsulating workpieces requiring high pressure and high temperature processing and methods for processing such workpieces.

A primary object of the present invention is to provide a container for the high temperature, high pressure processing of workpieces in which rapid encapsulation and removal of processed workpieces is possible.

Another object of the present invention is to provide a container which can be reused for numerous processing cycles.

Yet another object of the present invention is to provide a container and a method for continuous evacuation of the region of the workpieces during processing.

Another object of the present invention is to provide a method for processing workpieces in a continuously controlled environment throughout the processing cycle.

Yet another object of the present invention is to provide a container and method to continuously monitor the pressure inside the container during processing, thereby detecting through pressure changes possible undesirable leaks in the container.

Yet another objective of the present invention is to provide a method for the rapid removal of binding agents from partially densified or performed workpieces while maintaining such workpieces in substantially their desired shaped and without the introduction of undesirable porosity.

Another object of the present invention is to provide a container and method to apply high pressure to interior openings in a workpiece (typically, the inner diameter of a substantially toroidal-shaped workpiece), in addition to external applications of hydrostatic pressures.

Yet another object of the present invention is to provide a method for processing workpieces in a continuously controlled environment of gases throughout the processing cycle in which a backfill of reactive gases is performed, permitting chemical modifications of the workpieces to occur simultaneously with high pressure processing.

Another object of the present invention is to provide a method for processing workpieces at high temperature and high pressure and, in a single processing cycle, process at a range of temperatures to determine, in a single cycle, information about the effect of various processing temperatures on the workpieces.

DESCRIPTION OF PREFERRED EMBODIMENTS

The present invention consists of a container, or "can" for holding typical workpieces for high temperature, high pressure processing typically known as "hot-isostatic-pressing" or simply "HIP". As discussed under Background, HIP processing is used for solid workpieces requiring full densification, for semisolid workpieces typically made from powders formed tenuously into shape by mechanical pressing (or modest heating and pressing), or held together by binding agents, or for the one-step compaction of powders held by a mold into fully solid parts. For economy of language, we will use the term "workpiece" to denote any of these solid, semisolid or powder forms to be HIP processed. Likewise for economy of language we will describe in some detail the use of the present invention as a can for media HIP processing. Various modifications for conformal canning, or for the compaction of powders, will be noted or will be obvious to those with ordinary skills in the art.

Figure 1:
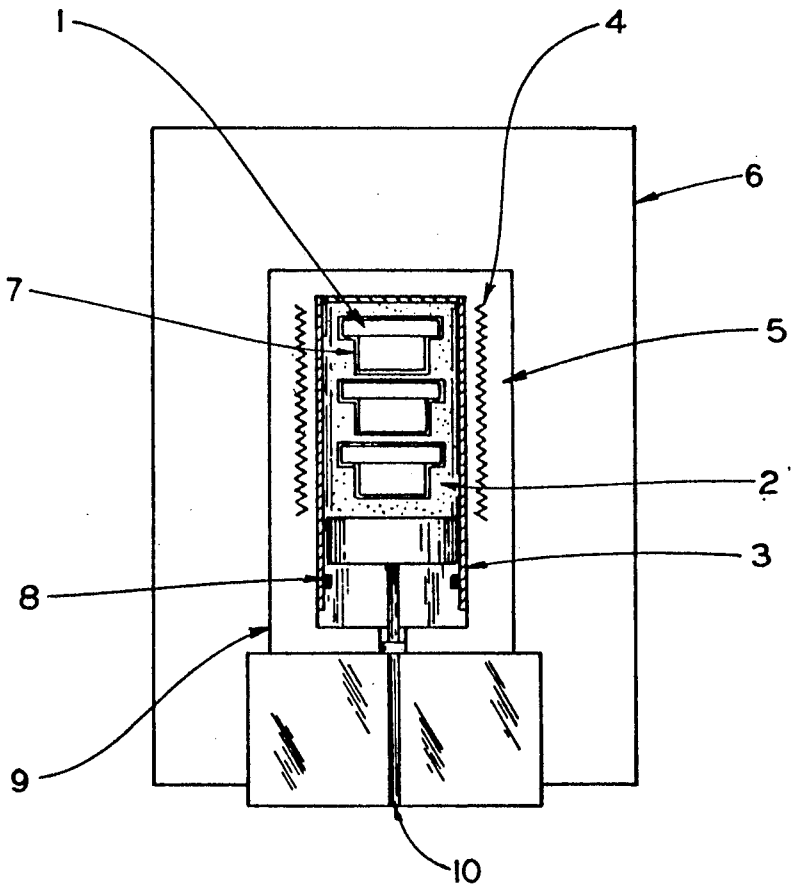
FIG. 1 A cross-sectional view of a typical container for media hot-isostatic-processing including workpieces, canning medium, and the container; following a typical embodiment of the present invention including typical heating elements and pressure chamber.

FIG. 1 shows in cross-section a typical apparatus for HIP processing. In this typical case, we show a plurality of identical workpieces, 1, surrounded by canning medium, 2, for pressure transmission to the workpieces, and placed inside can, 3, tightly sealed on all sides but one where it is sealed with a key feature of the present invention, plug 9. We also note in FIG. 1 a coating, 7, applied to the surfaces of workpieces. In some cases, medium 2, tends to stick to the workpieces by the heat and pressure of typical HIP processing. It is, therefore, occasionally useful but not required to coat the surface of the workpieces with a release agent facilitating the separation of the processed workpieces from the pressure transmitting medium.

Workpieces, 1 in FIG. 1 may be solid, semisolid, or powder held together in a suitable way during processing. Typically, loose powder is compacted by conformed canning in which the can itself provides the mold or form giving the power its desired final shape following compaction. Such applications of the present invention to conformal canning are obvious modifications to the media canning described in detail here. Simply, use a can in the shape of the desired part and dispense with medium, 2. (Although, for conformal canning also, it is frequently useful to use a release-facilitating coating 7, depending on the nature of the workpieces and the interior surface of the can.)

The HIP can is typically placed inside a high pressure chamber, 5, surrounded by a pressure-containment wall, 6. Heaters, 4 are typically provided inside the high pressure chamber to heat the workpieces during processing.

FIG. 1 illustrates one feature of the present invention. The can, 3 keeps the workpieces typically in the high temperature zone created by heaters, 4. But can 3, extends outside of the high temperature zone (but, typically, still lies inside the pressure chamber and, thus, will be subject to the high pressure, but perhaps not the full high temperature of HIP processing).

Figure 2:
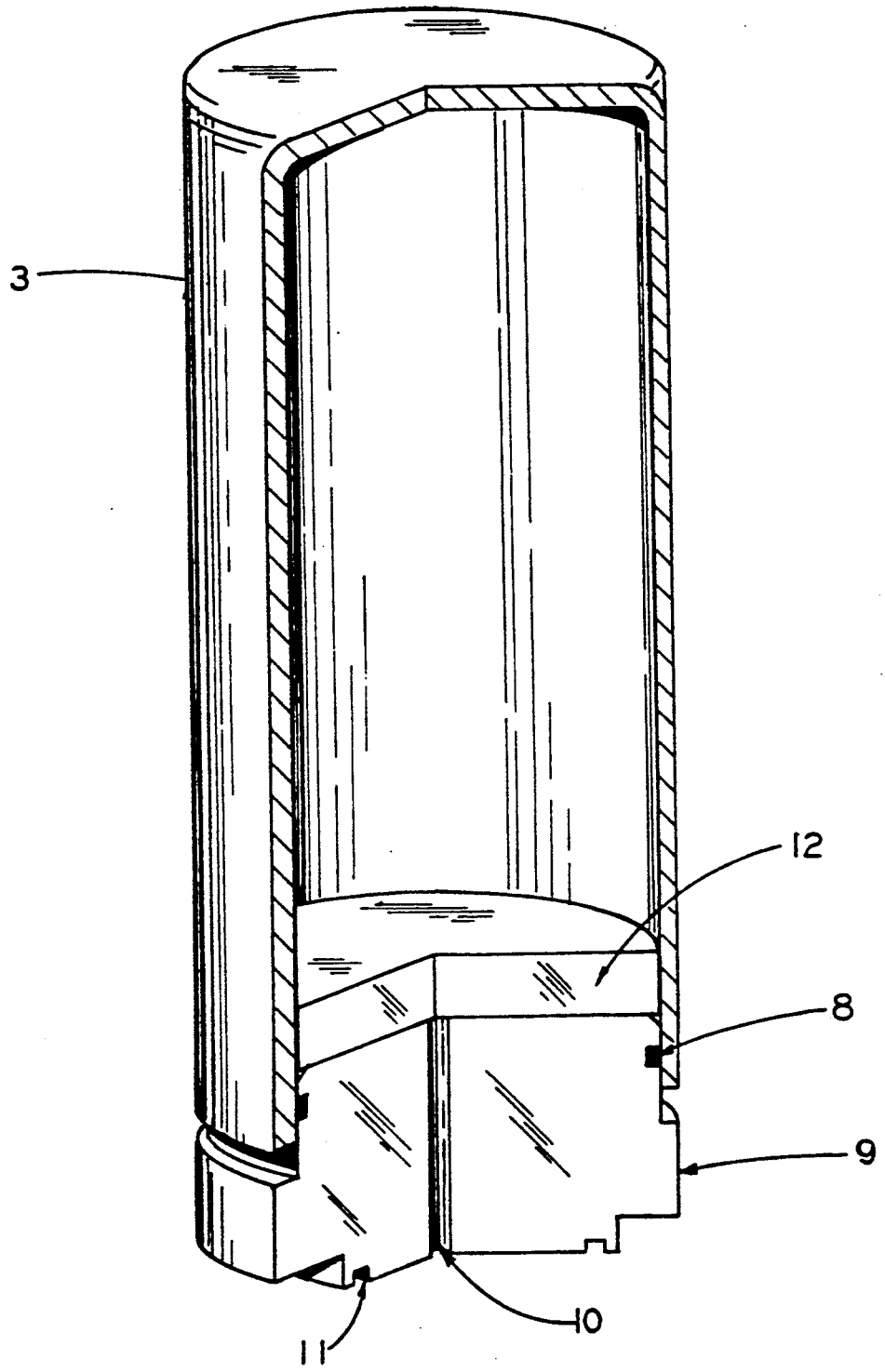
FIG. 2 A cross-sectional view of a typical embodiment of the workpiece container of the present invention.

FIG. 2 shows in cross-sectional view further details of the can. A sealed can 3 is produced by conventional methods, either formed seamlessly or produces by welding together a suitable metal structure. As noted above, this can should be long enough to keep the workpieces in the high temperature zone, but extend the open end and plug 9 outside of the zone of maximum temperature.

Figure 4:
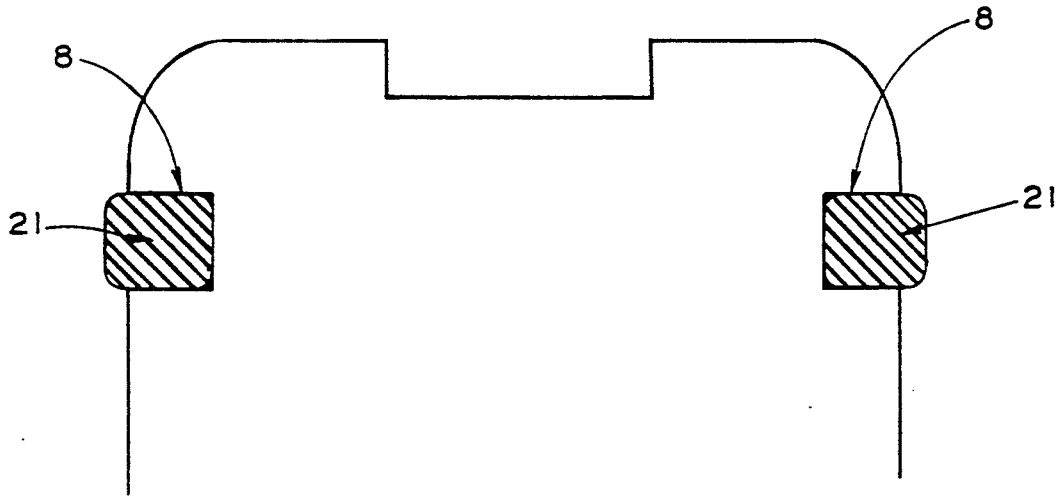
FIG. 4 A cross-sectional view of the sealing plug showing details of channel and sealing ring.
Figure 1:
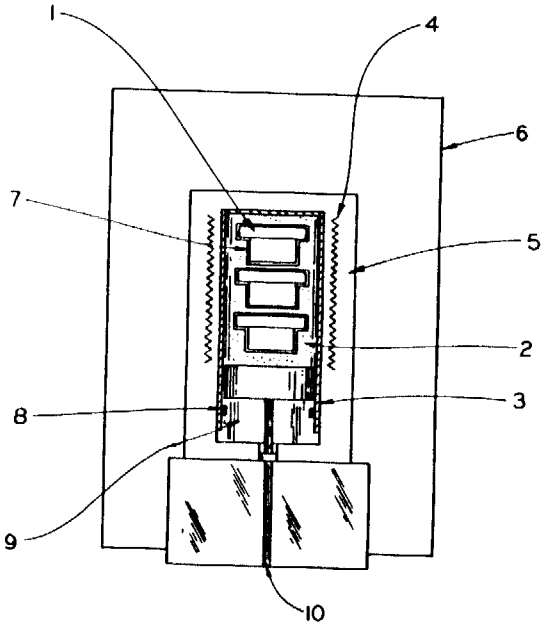

The HIP can, 3, is sealed by means of a plug, 9, with a tapered end having this tapered end projecting toward the interior of can 3. This plug is provided with a channel 8 into which is placed a sealing ring, typically a form of elastomeric "0-ring". A close-up view of channel 8 and sealing ring 21 is given in FIG. 4. To avoid undue clutter in the figures only channel 8 is indicated in other figures. It is understood that in actual use, plug 9 requires the use of sealing ring 21. The function of this sealing ring 21 in channel 8 is to provide an impermeable seal between the high pressure chamber, 2 and the interior of can 3, during the initial stages of processing. Typically, it would be very inconvenient to have a seal capable of withstanding the full pressure of typical HIP processing. However, this is not required in the present invention. The sealing ring 21 merely must provide an impermeable seal during the initial, relatively low pressure, phases of HIP processing. At higher pressures, can 3 will be compressed inward, tending to close around the circumference of plug, 9. The sealing ring 21 should be deformable, permitting a (typically) metal-to-metal pressure bond to occur between the metal surfaces of can 3 and plug 9. Thus, the function of the sealing ring 21 is to provide a temporary vacuum-tight seal for the early phases of HIP processing. Such seal should be deformable under higher pressures to not unduly impede the formation of direct bonding between the interior surface of can 3 and the surface of plug, 9. In practice it is found that conventional elastomeric O-ring seals function quite adequately in this application since (as described elsewhere herein), the seals are not required to withstand the high temperatures typical of HIP processing.

In typical operation for HIP processing of workpieces, a thermally insulating barrier 12, is placed between plug 9 and the interior of can 3 wherein the workpieces are placed. The plug, 9 is typically located outside the zone of maximum temperature, but insulating barrier 12 is frequently useful to reduce the heating of plug 9, seal in channel 8 and other areas. The thermal barrier, 12 must not form a gas-tight vacuum barrier preventing gases from exiting via vacuum port 10. Also, the properties of barrier 12 should not substantially change under the temperature and pressure conditions that it experiences during the HIP processing cycle, that is it typically must be "un-HIP-able".

Plug 9 lies outside the zone of maximum temperature and is partially screened from the inner surface of can 3 by a sealing ring 21. Therefore, the outer surface of plug 9 and the inner surface of can 3 are not permanently bound together by HIP processing. Therefore, following processing, it is relatively easy to remove plug 9 and remove the processed workpieces. Unlike conventional HIP processing, the can does not have to be removed by cutting or chemical means. This markedly reduces the time and labor involved in typical HIP processing. To facilitate removal of plug 9 following processing, it is occasionally convenient to coat the outer surface of plug 9, or the opposite inner surface of can 3 (or both) with a suitable release agent, as is common in the field.

The presence of removable plug 9 allows the can, 3 to be processed for reuse. Typically, can 3 will be distorted in size and shape following HIP. However, it can quickly be returned to its desired size and shape by placing it in a suitable mold, replacing plug 9, and introducing positive pressure into the interior of can 3 until conformity to the mold is achieved. Typically, it is convenient to heat can 3 to facilitate such conformation to the mold. However, the present invention permits such rapid access to the workpieces that, typically, the can 3 will already be hot from HIP processing and require no further heating (although a separate heating step can be used if desired). Therefore, by prompt use of a mold, reinsertion of plug 9 and introduction or positive pressure through port 10, the can 3 can be returned to its original shape for reuse. Cans for some applications cost hundreds or thousands of dollars. Reuse provides an attractive economy. Also, reuse of a can demon206 leak-free, reduces the chances of leakage spoiling later HIP-processed workpieces.

Another important feature of the present invention is the vacuum port, 10 providing access to the interior of can 3 continuously during processing. As shown in FIG. 1, the vacuum port extends through the pressure wall, 6, permitting access to the region of can, 3 containing the workpieces. Being removed from the zone of maximum temperature, the vacuum port 10 is easily kept open throughout the entire HIP processing cycle, (although with a careful selection of materials, this can be accomplished even though vacuum port 10 lies in whole or in part in the zone of maximum temperature.)

These structures allow a variety of very useful tasks to be accomplished during HIP processing.

First of all, a vacuum pump can be connected to port 10 and continuously pull a vacuum during the entire processing cycle. Thus, as voids are removed from the workpieces, and internally trapped gases are expelled and as densification of the workpieces provides additional free volume, excess gases are continuously removed. This can improve the quality of the resulting products.

In addition, it sometimes happens that the can for HIP processing is not completely gas tight. A vaccum leak in the can may ruin the entire HIP cycle, the workpieces and the can. More insidiously, the gas leak can be rather slow so the workpieces are not obviously ruined. However, the gas introduced by such work slow leakage may be incorporated into the workpieces to introduce harmful porosity into the workpiece when it is in service at elevated temperature. Such "thermally induced porosity" is a serious problem in applications where failure of a workpiece in service can be catastrophic (such as aircraft components, for example).

The container of the present invention provides a simple solution to this problem of gas leakage. The vacuum port, 10 allows continuous monitoring of the pressure within can, 3. Thus, any leak will show up as a rise in pressure measured through vacuum port, 10, making the operators aware of problems with that particular can and, therefore, those particular workpieces. The present invention makes such quality control measurements very convenient through port, 10.

In addition, many ports are made with the help of a binding agent to hold together powers for processing. The problem then arises of removing such binding agents without destroying the properties of the piece. It is not unusual for such "debinding" processes to require days or weeks of careful healing to drive off the binding agents without causing thereby serious damage to the piece. The present invention can reduce the time for such debinding, sometimes dramatically. Rather than applying full HIP pressures and temperatures, modest pressures are applied sufficient to keep the pieces in their desired shape. With such "constraining pressure" (less than densification pressures), heat is applied and a vaccum applied to the pieces through port 10. Without the use of constraining pressure, rapid application of heat and pressure will cause the pieces to loose their shapes as binding agents quickly exit. This problem can be avoided with the present invention.

Figure 3:
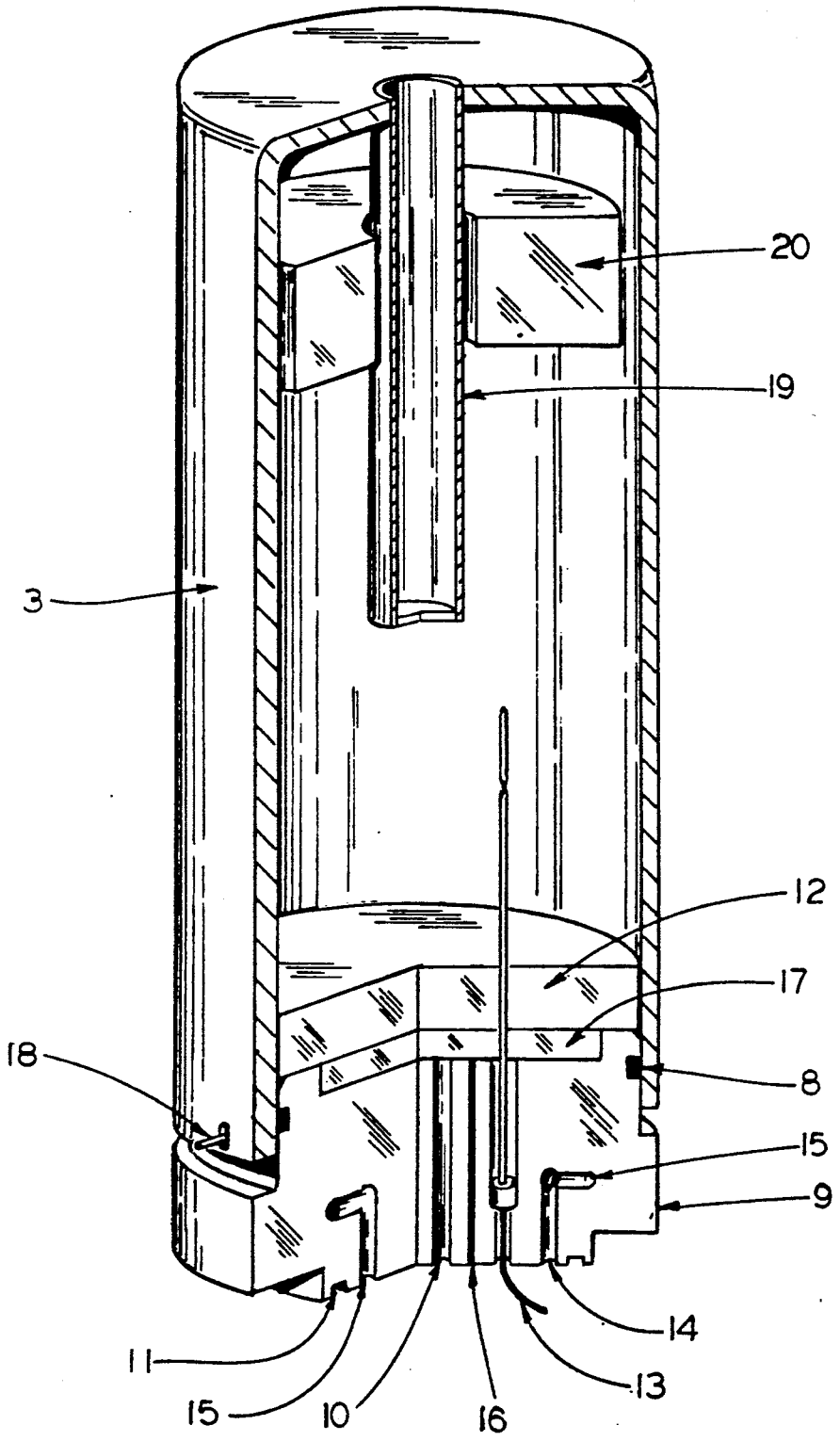
FIG. 3 A cross-sectional view of the workpiece container including many features which are frequently (but not always) useful in the practical utilization of the present invention.

In FIG. 3 we show a can of the type typically used in the present invention, having many features proving useful in practice. These features are useful, but are not essential for the application of the present invention. One with ordinary skills will readily understand in a given process which features are helpful and which can be omitted.

It may be useful to circulate cooling fluid through the plug 9. Depending on the geometry of the can, plug and heating elements, and on the processing temperatures and times, such cooling fluids may be useful to keep the temperature of the O-ring seal 21 within its operating range. This can be accomplished by inclusion in plug 9 of cooling channels 14 and 15.

It is often helpful to allow for instrumentation to be placed inside the can 3, which can be accomplished through instrumentation port 13. In typical operation, plug 9 will sit on a baseplate provided on the pressure chamber. A main seal between plug, 9 and the baseplate of such pressure chamber will be provided, 11. In addition, it is often helpful, to have retaining pins, 18 to keep plug 9 in approximate position before the start of the HIP cycle.

FIG. 3 also shows a barrier 17, in addition to thermal barrier, 12. This barrier is occasionally useful for keeping medium 2 (if any) from making its way through porous barrier 12 and clogging the barrier various ports in plug 9. We noted elsewhere that barrier 12 must be porous to allow gases to exit via vacuum port 10. Such porosity is typically sufficient to prevent the passage of medium, 2 while allowing satisfactory gas flow. For those instances when thermal barrier, 12, is not sufficient to bar medium 2 from the ports in plug, 9, an additional barrier can be introduced, 17.

FIG. 3 also shows as port 16, a second auxiliary access port through plug 9. Certain workpieces are improved by processing in controlled gaseous environments. By using ports 9 and 10 in combination it is possible to maintain a reasonably pure gaseous atmosphere circulating continuously around the workpieces during processing, continuously removing out-gassed products from the workpieces and maintaining the desired atmosphere throughout the processing cycle. In many cases, this controlled atmosphere can be maintained adequately well by use of a single port, 10. However, for those cases in which this is not true, it is obvious to provide a second port 16.

Several modifications to the above typical embodiment can be made when workpieces do not require all features described above, or alternatively, special processing is required.

Not all workpieces require evacuation of the can prior to sealing. In such cases a solid plug, 9, can be used omitting entirely access port 10. This simplification can be useful for HIP processing in which the workpieces are impervious to surrounding gases sealed in the can or generated during the HIP cycle itself. The advantages of reuse and rapid access will still be present even in the absence of port 10.

For some workpieces, it is convenient to keep the workpiece in a controlled environment during processing. For example, reactive gases (such as $H_2$, $N_2$, $O_2$, and others) can be introduced via port 10 to react with the workpiece during HIP processing, changing the properties of the workpiece during the cycle. The composition of such reactive gases will typically change as the desired reaction with the workpiece proceeds to completion. Therefore, continuous flow of such gases through the can will assist in maintaining the desired composition of the reacting gases. Typically, it will be convenient to maintain such flow by using more than one port, 10, through the sealing plug, 9, providing a separate channel (or channels) for inflow and outflow of reactive gases and reaction products. This can be accomplished by having a plurality of ports through plug 9. Alternatively (or in addition) a second plug assembly, having one or more access ports therethrough could be used in place of the tightly sealed end of container 3. In this alternative embodiment, both ends of container 3 would have removable plugs, each plug having at least one access port therethrough. Each of said plugs would be located away from the heating zone of the HIP furnace allowing sealing in the manner described in detail previously. This dual plug structure would provide end-to-end flow of reactive gases over the workpieces continuously during the HIP cycle.

FIG. 3 also illustrates a structure of the can and a procedure for HIP processing workpieces having inner openings, such as gears, cylindrical parts and similar workpieces. We show such a typical workpieces as 20 in FIG. 3. The problem with such parts is that, occasionally medium 2 for transmitting pressure to the workpieces does not adequately penetrate the interior diameter, thereby giving nonuniform processing. The "soft mandrel" 19 is a solution to this problem. Manrel 19 provides access from the outside of can 3 to the interior openings in workpieces 20. Under the heat and pressure of HIP, mandrel 19 will deform (just like the rest of can 3 subject to similar conditions of temperature and pressure). Thus, mandrel 19 will provide HIP processing from the inside of such open workpieces, increasing the efficiency and reliability of HIP for such workpieces.

Another interesting and useful process is possible with the encapsulation technique of the present invention. It is open required in the HIP procesing of different workpieces to experiment with a range of pressures and temperatures to find those values leading to the desired results in the HIP processed workpiece. The present invention has the can extending outside of the hot zone of the HIP furnace. For many applications, all parts of all workpieces must receive the same processing pressures and temperatures. Thus, the workpieces must all lie well within the heating zone of the HIP furnace. However, for experimentation purposes, it is quite feasible with the present invention to have a workpiece lying both in the hottest zone of the furnace and extending outside of this zone in the direction of plug 9. Thus, a single HIP cycle will cause the workpiece to receive a range of temperatures from the interior of the furnace to the region near the plug. By taking cross sectional samples of such a workpiece (or by using a stack of several idential workpieces) the effects of various temperatures can be estimated, not to high accuracy certainly, but sufficient to provide useful guidance in designing HIP process parameters for production.

Yet another application is possible with the present invention. In the HIP processing of some workpieces using media HIP, heat transfer from furnaces 4, through the medium, 2, to the workpiece 1 is not as efficient as desired. Using the present invention, with the possibility for backfilling with selected gases through port 10, an attack on this problem can be made by backfilling the region surrounding the workpiece with a gas having high thermal conductivity (such as helium). This would facilitate heat transfer from the walls of the container, 3, to the workpiece, 1 and counteract in part any deleterious thermally insulating properties of the medium 2.

When using media HIP, care must be taken in the selection of the medium, 2, The primary function of the medium is to close open porosity in the workpiece, 1. Therefore, the medium must not penetrate such open porosity. But other considerations affect the choice of medium as well. For example, certain media can react chemically with the workpiece under the HIP processing conditions and adversely affect the properties of the workpiece. Also, under HIP conditions the workpiece may bond so tightly to certain media as to render the HIP processed workpiece into scrap. All these considerations are relevant in choosing a medium for HIP processing. In some practical instances, the medium itself becomes solid and dense under the temperature and pressure of a HIP cycle, leading to the possibility that differential thermal expansion of medium and workpiece can distort (or even rupture) the workpiece. The present invention offers a solution to the problem of densification of the powder HIP media during HIP processing and thereby expands the range of choices of the process designer.

For the case of media HIP using a powder medium, it is feasible with the present invention to perform a two-step HIP process. The workpieces 1, medium 2 and can 3, are evacuated through port 10 and held under vacuum while the HIP processing cycle is begun. After a time, the workpieces will have typically closed all open porosity, but still require further processing to become fully dense. However, full HIP processing will (in some cases) cause densification of the medium and consequent harm to the workpiece. The present invention allows the HIP cycle to be briefly paused after open porosity in the workpieces has been removed, but before damaging transformations of the medium have occurred. The port, 10, providing access to the region of the workpieces, is no longer used to draw a vacuum. Rather, when open porosity is removed, the can is backfilled through port 10 with an inert gas (typically argon) such that the presence of this backfilled gas prevents the HIP-induced transformation of the medium. However, since open, porosity is no longer present in the workpiece, penetration of the workpiece by the gas does not occur. The full HIP processing of the workpiece in the presence of the backfilled gas then proceeds to completion.

I claim:

1. A countainer for the encapsulation of workpieces during high pressure, high temperature processing inside a pressure-containment vessel, comprising;

a) an elongate tube containing said workpieces, said tube being sufficiently compressible at elevated processing temperatures to compress said workpieces, and b) a means for sealing said tube at a first end thereof, said tube having a length sufficient for the opposite, second end of said tube to project beyond the region within said pressure-containment vessel in which elevated processing temperatures occur, and c) a plug sealing the opposite second, end of said tube, said sealing plug tapered on one end thereof with narrower dimension directed towards the interior of said tube, and said sealing plug having a circumferentail channel containing a sealing ring therein surrounding said sealing plug in contact with the interior face of said tube, wherein said sealing ring provides an impermeable seal between said sealing plug and said tube during the initial application of pressure, said sealing ring being compressible under further application of pressure to allow direct pressure bonding to occur between the external surface of said sealing plug and the interior surface of said tube.

2. A container for the encapsulation of workpieces as in claim 1 wherein said means for sealing said first end thereof comprises welded seal.

3. A container for the encapsulation of workpieces as in claim 2 further comprising at least one opening axially through said sealing plug providing access therethrough to the interior of said elongate tube.

4. A container for the encapsulation of workpieces as in claim 2, further comprising a thermally insulating barrier located axially between the narrow surface of said sealing plug and the interior of said elongate tube.

5. A container for the encapsulation of workpieces as in claim 2, further comprising internal passages in said sealing plug for the circulation of cooling fluid.

6. A container for the encapsulation of workpieces as in claim 2, wherein the circumferential surface of said sealing plug and the radially opposite interior surface of said elongate tube have coatings thereon facilitating debonding of said surfaces following high temperature and high pressure processing.

7. A container for the encapsulation of workpieces as in claim 1, wherein said elongate tube has sufficient length for both said first and second ends thereof to project beyond said region within said pressure-containment vessel in which elevated processing temperatures occur, and wherein said first end is sealed by means of a first sealing plug tapered on one thereof with narrower dimension directed towards the interior of said tube, and said first sealing plug having a circumferential channel containing a sealing ring therein surrounding said first sealing plug in contact with the interior face of said tube, wherein said sealing ring provides an impermeable seal between said first sealing plug and said tube during the initial application of pressure, said sealing ring being compressible under further application of pressure to allow direct pressure bonding to occur between the external surface of said first sealing plug and the interior surface of said tube, further comprising at least one opening axially through said first sealing plug providing access therethrough to the interior of said elongate tube.

8. A container for the encapsulation of workpieces as in claim 7, further comprising a thermally insulating barrier located axially between the narrow surface of said first sealing plug and the interior of school elongate tube.

9. A container for the encapsulation of workpieces as in claim 7, further comprising internal passages in said first sealing plug for the circulation of cooling fluid.

10. A container for encapsulation of workpieces as in claim 7, wherein the circumferential surface of said first sealing plug and the radially opposite interior surface of said elongate tube have coatings thereon facilitating debonding of said surfaces following high temperature and high pressure processing.

11. In combination, a container for the encapsulation of workpieces as in claim 3, together with a vessel within which said high temperature and high pressure is produced and contained and in which said container is processed; wherein said container has a permanently sealed first end thereof located within said vessel so as to receive both elevated temperature and pressure while the opposite, second, end of said container lies outside said region within said vessel; anf further comprising a pressure impervious tubular means for continuous access to said workpieces inside said container from outside said vessel passing through said second end of said container.

12. In combination, a container for the encapsulation of workpieces as in claim 7, together with a vessel within which said high temperature and high pressure is produced and maintained, and in which said container is processed; wherein said container has the midportion thereof located within said vessel so as to receive both elevatd temperature and pressure, while both ends of said container lie outside said region of high temperature processing within said vessel; and further comprising at least two pressure-impervious tubular means for continuous access to said workpieces inside said container from outside said vessel, at least one of said tubular access means passing through each end of said container.

13. A method for high temperature, high pressure processing of workpieces comprising the steps of:

(a) encapsulating said workpieces in a deformable container wherein said container allows continuous access to said workpiece by means of pressure-impervious tubes;

(b) continuously evacuating said container encapsulating said workpieces by means of continuous application of vacuum through said pressure impervious tubes while subjecting said workpieces to high temperature, high pressure processing.

14. A method as in claim 13, further comprising the steps of continuously monitoring the pressure in said encapsulating container through said access means, and terminating said processing if evidence of undesired leakage occurs.

15. A method for high temperature, high pressure processing of workpieces encapsulated in a container, comprising the steps of maintaining said workpieces in a controlled environment of gas during processing, said gas introduced and maintained in the region of said workpieces by flowing said gas through a pressure-impervious means of access to the interior of said encapsulation container.

16. A method for processing as in claim 15 wherein said gas causes chemical reactions with said workpieces.

17. A method for processing as in claim 15 wherein said gas increases the thermal conductivity of the region surrounding said workpieces.

18. A method for removing binding agents from workpieces comprising the steps of:

a) encapsulating said workpieces in a container and placing said container in a high pressure, high temperature processing chamber, and b) applying sufficient pressure to said container such that, upon subsequent heating, said workpieces therein substantially retain their dimensions, and c) heating said container and said workpieces to a temperature sufficient to volatilize said binding agents while, simultaneously and continuously, evacuating said volatilized binding agents through a pressure-impervious access means to the interior of said container, said heating and evacuation performed for sufficient time to remove substantially all of said binding agents, and d) releasing said applied pressure and retrieving said workpieces.

19. A method for removing binding agents from workpieces as in claim 18, further comprising the additional step, immediately following step c, of;

c-1) applying increased pressure and temperature to said container and said workpieces of sufficient magnitude for sufficient duration substantially to fully densify said workpieces.

20. A method for restoring an encapsulation container to dimension suitable for reuse, following high pressure high temperature processing of workpieces contained therein comprising the steps of;

a) processing at high temperature and high pressure said container and workpieces therein, and b) removing the end plug and said workpieces from said container, and c) replacing said plug and placing said container into a mold having the shape and dimensions desired of a container for reuse, and d) applying pressure to the interior of said container sufficient to conform said container to the shape and dimensions of said mold.

21. A method as in claim 20 for restoring a container, wherein said pressurizing step (d) is performed sufficiently soon after processing step (a) that said container is sufficiently hot to facilitate deformation to the desired shape and dimensions.

22. A container as in claim 2, further comprising an integral, permanently sealed, inwardly directed protrusion from said first end of said elongate tube into the interior of said tube, wherein said protrusion extends into and is surrounded by an interior surface of said workpieces, and , during high temperature, high pressure processing of said workpieces, said protrusion applies pressure radially outward from the center axis of said elongate tube to said inner surface of said workpieces.

23. A container as in claim 3, further comprising an integral, permanently sealed, inwardly directed protrusion from said first end of said elongate tube into the interior of said tube wherein said protrusion extends into and is surrounded by an interior surface of said workpieces, and, during high temperature, high pressure processing of said workpieces, said protrusion applies pressure radially outward from the center axis of said elongate tube to said inner surface of said workpieces.

24. A method for high temperature, high pressure processing of workpieces, wherein said workpieces receive a spatially nonuniform temperature distribution in a single processing cycle, comprising the steps of;

a) encapsulating said workpieces in a container, and b) placing said container and the workpieces contained therein, in such location in proximity to the boundary of the region of the processing a chamber subject to high temperatures, such that said workpieces receive a spatially nonuniform temperature during processing, and c) performing a single high temperature high pressure processing cycle resulting in said workpieces processed at various temperatures following the completion of said single processing cycle.

25. A method for high temperature, high pressure processing of workpieces while reducing the densification of pressure-transmitting medium surrounding said workpieces, comprising the steps of;

a) placing said workpieces in an encapsulation container and surrounding said workpieces with pressure-transmitting medium placed in said container, and b) subjecting said container and said workpieces therein to temperature and pressure sufficient to close open porosity in said workpieces, and c) filling the region surrounding said workpieces with gas, permeating said medium sufficiently to avoid densification of said medium upon further high temperature, high pressure processing.

* * * * *

UNITED STATES PATENT AND TRADEMARK OFFICE

CERTIFICATE OF CORRECTION

PATENT NO. : 5,137,663

DATED : August 11, 1992

INVENTOR(S) : Robert M. Conaway

It is certified that error appears in the above-indentified patent and that said Letters Patent is hereby corrected as shown below:

The drawing sheet, consisting of Fig. 1, should be deleted to be replaced with the drawing sheet, consisting of Fig. 1, as shown on the attached page.

Column 1, line 46, insert the ferm "fluids" between "term" and "commonly".
Column 1, line 56, "power" should read --powder--
Col. 3, line 45, "in corporated" should read --incorporated--
Col. 3, line 47, "driver" should read --drive--
Ccl. 5, line 49, "produces" should read --produced--
Col. 6, line 25, insert "21" between "seal" and "in"
Col. 6, line 64 and 65, cancel "demon206" on lines 64 and 65 and replace with "demonstrated by prior usage to be"

UNITED STATES PATENT AND TRADEMARK OFFICE

CERTIFICATE OF CORRECTION

PATENT NO. : 5,137,663

DATED : August 11, 1992

INVENTOR(S) : Robert M. Conaway

It is certified that error appears in the above-identified patent and that said Letters Patent is hereby corrected as shown below:

Column 7, line 41, cancel "Ports" and replace with --Parts --.

Column 7, line 46: cancel "healing" and replace with "heating".
Column 7, line 56: cancel "loose" and replace with "lose".
Column 8, line 17: cancel "barrier".
Column 9, line 17: cancel "Manrel" and replace with "Mandrel".
Column 9, line 28: cancel "open" and replace with "often".
Column 10, line 33: cancel the comma "," from this line.

Column 10, line 38: cancel "countainer" and replace with "container".

Signed and Sealed this

Seventh Day of December, 1993

*Attest:*

*Attesting Officer*

Bruce Lehman

BRUCE LEHMAN

*Commissioner of Patents and Trademarks*